US005630735A

United States Patent [19]

Eckert

[11] Patent Number: 5,630,735

[45] Date of Patent: May 20, 1997

[54] ELECTRICAL CONNECTOR

[76] Inventor: John C. Eckert, 11442 Applegrath Way, Germantown, Md. 20876

[21] Appl. No.: 499,657

[22] Filed: Jul. 7, 1995

[51] Int. Cl.[6] ..... H01R 9/22

[52] U.S. Cl. ..... 439/721; 439/810

[58] Field of Search ..... 439/721, 709, 439/722, 723, 724, 715, 716, 725, 727, 784, 790, 791, 793, 796, 797, 805, 810

[56] References Cited

U.S. PATENT DOCUMENTS

| | | | |
|---|---|---|---|
| Re. 28,877 | 6/1976 | Pertuit | 439/723 |
| 270,478 | 1/1883 | Pumphrey | 403/206 |
| 1,642,345 | 9/1927 | Telford | 439/797 |
| 2,831,914 | 4/1958 | Jacobs | 439/721 |
| 2,917,724 | 12/1959 | Jackson | 439/721 |
| 3,016,512 | 1/1962 | Borchard | 439/721 |
| 3,864,013 | 2/1975 | Levy | 439/724 |
| 4,303,295 | 12/1981 | Schreder | 439/359 |
| 5,137,476 | 8/1992 | Noble | 439/797 |

*Primary Examiner*—Hien Vu

*Attorney, Agent, or Firm*—Ostrolenk, Faber, Gerb & Soffen, LLP

[57] ABSTRACT

An electrical connector for coupling together at least two electrical conductors in electrically conductive relationship to each other is disclosed. The connector is a plastic, nonconducting block encasing an electrically conductive bus exchange. The bus exchange is a conductive metal sheet with at least one rolled, hollow portion for receiving and electrically coupling a pair of said electrical conductors. The rolled portion includes two crimps disposed approximately at the rolled portion in mirror opposition which serve as respective contact stops for the electrical conductors. The electrical conductors preferably comprise insulated electrical wires with stripped ends, the stripped ends being received in the electrically conductive bus exchange. The block includes longitudinal bores for receiving the electrical wires to be connected. To secure the electrical wires within the connector, insulated screws are inserted into transverse bores in the block which are perpendicular to, and intersect, the longitudinal bores. The screws abut against insulated portions of the electrical wires within said block to hold the wires in place.

7 Claims, 3 Drawing Sheets

ELECTRICAL CONNECTOR

BACKGROUND OF THE INVENTION

1. Field of the Invention:

The present invention relates to an electrical connector and, more particularly, to a connector for coupling together at least two electrical wires in an electrically conductive relationship.

2. Description of the Related Art:

Wire nut electrical connectors are well known in the art. Wire nuts generally have a conical-shaped plastic housing with a ribbed or threaded metal insert on the inside of the plastic housing. In the use of a wire nut, the electrical wires to be joined are stripped, pigtailed with one another, and then inserted into the wire nut, which is then rotated so as to make a good contact of the stripped ends of the electrical wires with each other and with the metal surfaces on the inside of the plastic housing of the wire nut.

Wire nuts are relatively simple, inexpensive devices, but have several disadvantages. One disadvantage is the labor-intensive step of pigtailing the electrical wires before inserting them into the wire nut. Another disadvantage is that the electrical wires must be carefully inserted into the wire nut to ensure that the wire nut tightly grips the electrical conductors. Another disadvantage of wire nuts is that repeated connection and disconnection of the electrical wires from the wire nut may cause the electrical wire to become frayed and possibly to break off.

To overcome the above-noted disadvantages of conventional wire nut connectors, crimp-type electrical connectors were developed. In a crimp-type connector, a generally cylindrical sleeve, after receiving the electrical wires, is crimped at each end so that the electrical conductors are crimped between opposite walls of the sleeve.

While these prior crimp-type electrical connectors overcome some of the disadvantages of the prior conventional wire nut connectors, they also suffer from several disadvantages. One such disadvantage is the need for the use of a special crimping tool to crimp the sleeve ends. Not only is the tool required, but it is large and difficult to manipulate in confined spaces. Another disadvantage is that the electrical wires must be cut to remove them from the crimp-type connector. This may necessitate the labor-intensive step of stripping additional insulation surrounding the electrical wires before the wires can be reconnected. In addition, crimp-type electrical connectors are not reusable. Still another disadvantage of crimp-type connectors is that this type of electrical connector may not always reliably couple single-strand electrical wire (i.e., solid conductor wire). An additional disadvantage is that the rigidity of the sleeve must be limited so that the sleeve is soft enough to be crimped. Still another disadvantage of these connectors is that if the crimp is too tight, the conductor may be broken, and if too loose, the conductor may pull from the connector.

In an effort to address the above-noted deficiencies of the prior art, sleevelike insulated connectors have been developed, such as disclosed in U.S. Pat. No. 3,864,013 to Levy and U.S. Pat. No. 5,137,476 to Noble. In these devices, the electrical conductors to be joined are stripped and inserted into opposite ends of the sleevelike connector. The sleeve has an electrically conductive surface on the inside which electrically contacts and connects the two stripped conductors. Screws are inserted into the connector through apertures in the upper surface and are tightened directly against the conductors to secure the conductors against the conductive surface of the connnector sleeve.

While the above-described sleevelike connector devices are better than wire nuts and/or the crimp type connector for many applications, they are not fully versatile in that they can be used to connect only electrical conductors having a solid conductor wire against which a screw can be securely tightened. Additionally, although these devices are designed to be used with insulated screws or metal screws with insulating plugs, the direct contact of the screws against the live conductors presents a danger which may not be acceptable in many high-voltage applications. Moreover, when a screw is removed, intentionally or unintentionally, the conductor is exposed through the screw apertures, presenting an additional danger to the user and/or the surroundings.

SUMMARY OF THE INVENTION

The present invention is directed to an electrical connector which overcomes the disadvantages of the prior art noted above, while at the same time providing a device in which the coupling of two or more electrical conductors may be easily and quickly performed.

Specifically, the electrical connector of the present invention is a plastic, nonconducting block encasing an electrically conductive bus exchange. The bus exchange is a conductive metal sheet with at least one rolled, hollow portion for receiving and electrically coupling a pair of said electrical conductors. The rolled portion includes two crimps disposed approximately at the center of the rolled portion in mirror opposition which serve as contact stops for the electrical conductors.

The electrical conductors preferably comprise insulated electrical wires with stripped ends, the stripped ends being received in the electrically conductive bus exchange. The block includes longitudinal bores for receiving the electrical wires to be connected. To secure the electrical wires within the connector, insulated screws are inserted into transverse bores in the block which are perpendicular to, and intersect, the longitudinal bores. The screws, preferably formed of an insulating material such as nylon, abut the insulated portions of the electrical wires within said block to hold the wires in place.

Other features and advantages of the present invention will become apparent from the following description of the invention which refers to the accompanying drawings.

DETAILED DESCRIPTION OF THE PREFERRED EMBODIMENT

Figure 1:
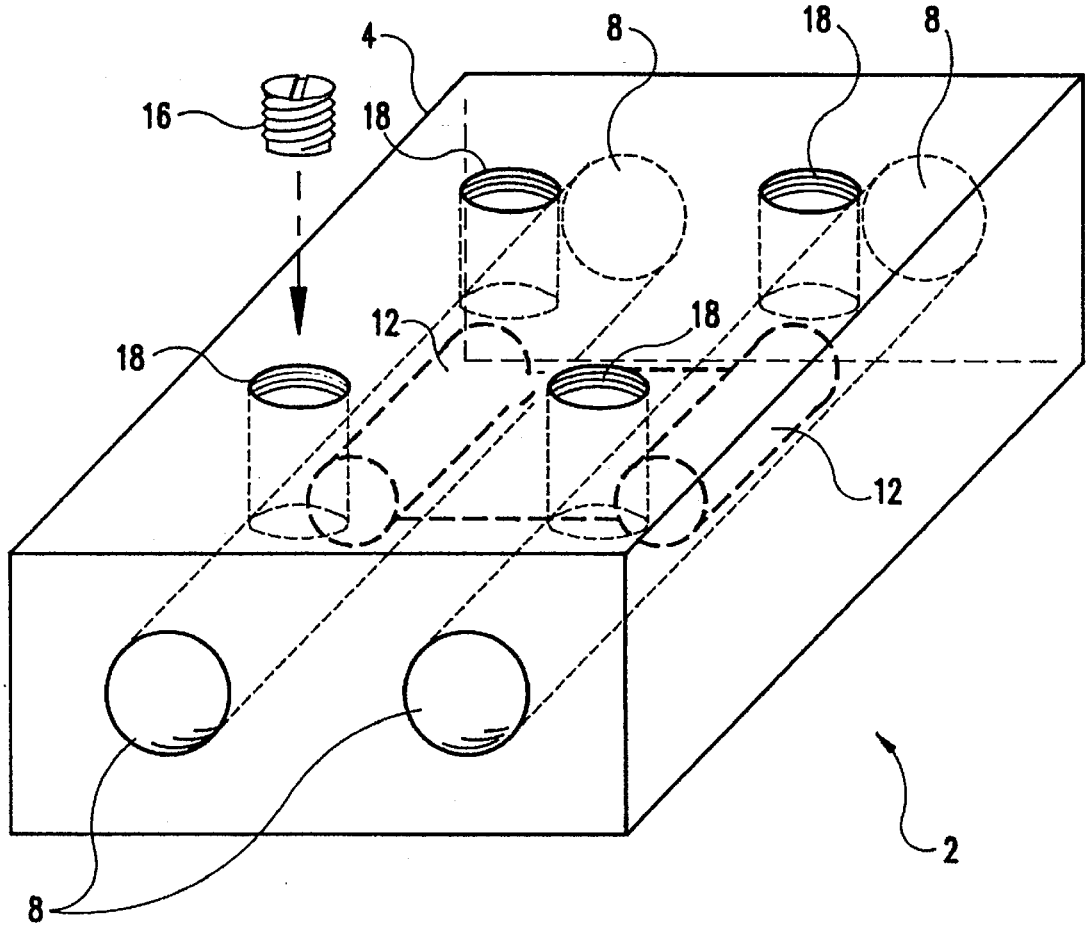
FIG. 1 is a perspective view of the electrical connector of the present invention.

Referring first to FIG. 1, a perspective view of the electrical connector of the present invention is shown, the electrical connector being indicated generally by reference numeral 2.

Connector 2 is formed of a plastic, nonconducting block 4 which encases an electrically conductive bus exchange 6 formed of a flat conductive material such as copper or a copper alloy. Block 4 is provided with a plurality of longitudinal bores 8 for receiving the electrical conductors to be electrically coupled. Longitudinal bores 8 extend from the outer ends of the block to the conductive bus exchange 6 encased within block 4.

In the preferred embodiment of the invention, plastic block 4 is formed of two joined molded pieces—a base piece having a recess on its upper surface in which conductive bus exchange 6 is mounted, and a top piece provided with bores as described herein. In the manufacture of the device, the top piece is joined with the base piece by applying heat or by any other conventional method.

Figure 2:
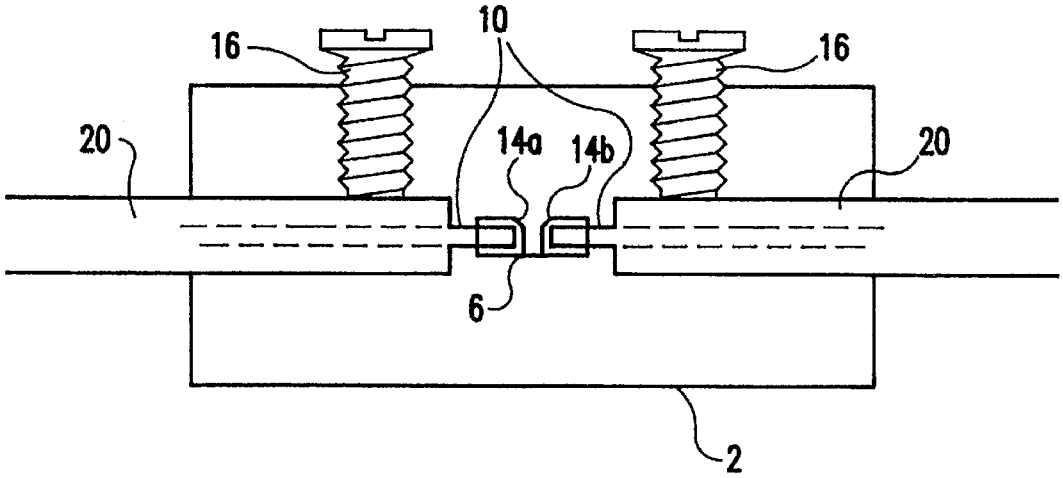
FIG. 2 is a side cross-sectional view of the electrical connector of the present invention, showing two wires secured therein.
Figure 3:
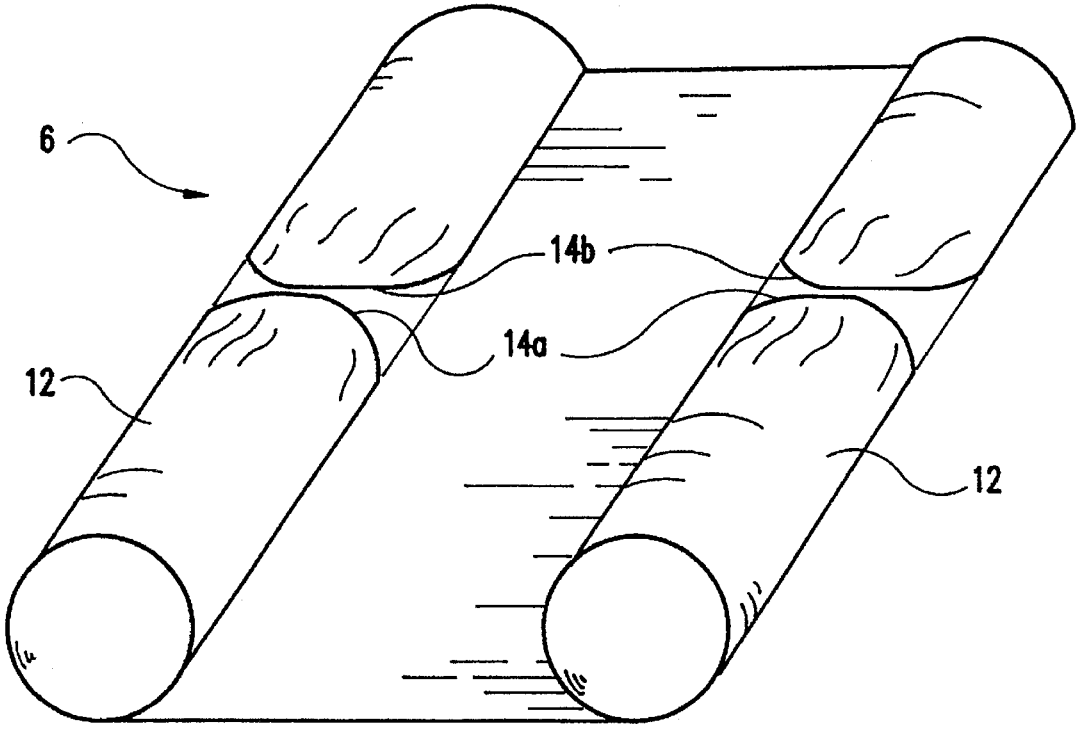
FIG. 3 is an enlarged view of the conductive bus exchange of the present invention.

The connector 2 of the present invention is designed to receive and electrically couple insulated electrical wires (either solid conductor, as shown on the right in FIG. 2, or stranded conductor, as shown on the left in FIG. 2) which have been stripped of insulation at their ends. As shown best in the side view of FIG. 2, when the wires to be electrically coupled are fully inserted into respective opposite ends of longitudinal bores 8, the stripped ends 10 of the wires slide into, and make electrical contact with, rolled portions 12 of conductive bus exchange 6. As shown in FIGS. 2 and 3 (FIG. 3 showing an enlarged view of the bus exchange), bus exchange 6 is preferably provided with two opposed central crimps 14*a* and 14*b* in each of the rolled portions 12 which respectively serve as wire stops and ensure that electrical contact to the bus exchange is made when the wires are fully inserted.

Referring back to FIG. 1, block 4 is also provided with a plurality of transverse bores 18 which are perpendicular to, and intersect longitudinal bores 8. To secure the electrical wires within the connector, insulated screws 16 are inserted into transverse bores 18, the transverse bores 18 being positioned so that the screws 16 abut the insulated (unstripped) portions 20 of the electrical wires to hold the wires in place.

Insulated screws 16 are preferably formed of nylon (although the screws can be formed of any insulating material) and the transverse bores can be tapped or untapped, depending, of course, on whether the screws are self-tapping. To facilitate insertion and tightening, screws 16 are preferably provided with heads having a triangular-shaped recess 22 for receiving a correspondingly triangularly-shaped tip 24 of an insertion tool 26—see FIGS. 4 and 5. Alternatively, in circumstances where sufficient screw head size and driving torque are available, it is possible to employ screws provided with a simple slot-like head which can be tightened with an ordinary screwdriver.

Figure 4A:
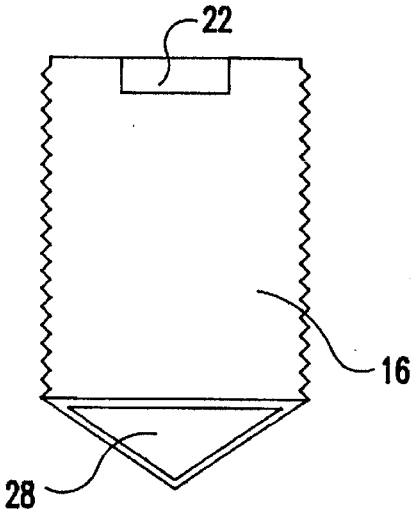
FIGS. 4A and 4B are side and top views, respectively, of the screw used in the present invention to secure the wire in the connector.
Figure 4B:
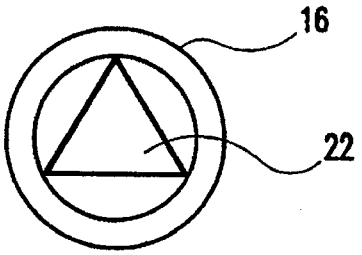
Figure 5:
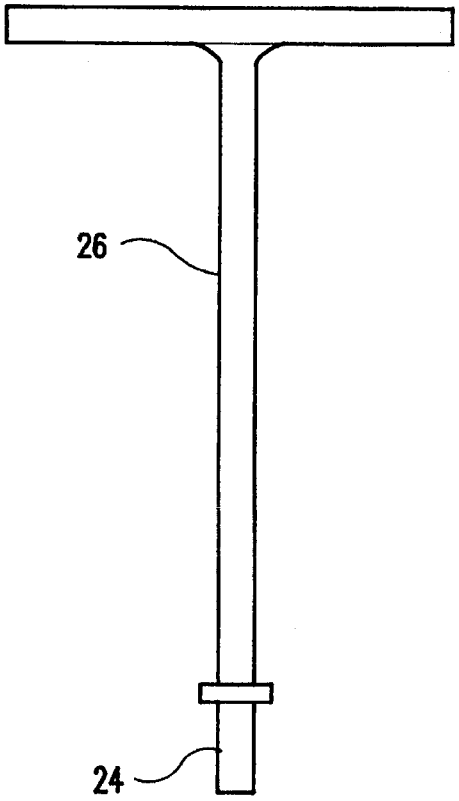
FIG. 5 is a side view of a tool which may be used to insert and remove the screws of the present invention.

In an optional embodiment of the invention, screws 16 may advantageously be formed of pliable plastic and provided with a convex hollow tip 28 (not airtight), as shown in FIG. 4A, which will flatten upon impact to grip the wire insulation better.

Although conductive bus exchange 6 is shown in FIGS. 1–3 as having two side-by-side rolled portions 12 for electrically connecting two respective pairs of wires, the bus exchange can obviously be provided with only one rolled portion 12 (and only one set of aligned longitudinal bores 8 and transverse bores 18). Conversely, the present invention can also be provided with a bus exchange having three or more (n) rolled portions 12 (provided in a larger block with a corresponding number of longitudinal and transverse bores) for receiving and electrically connecting 2×n number of electrical wires. If less than the full number of available longitudinal bores are used to couple wire, the unused bores (and the corresponding transverse bores) are preferably plugged with screws or other insulating material.

Additionally, it should be appreciated by those of skill in the art that the present invention is not limited to any particular size, and may be used for applications ranging from the electrical coupling of large insulated cables to micro-applications requiring special conductivity such as platinum, gold or silver, the only limitation on size being the physical ability to insert a set screw.

Thus, although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. An electrical connector for coupling together at least two insulated electrical (conductors) wires in electrically conductive relationship to each other, wherein insulation has been stripped from the ends of the wires, said connector comprising:

a block formed of an electrically insulating material and having:

longitudinal bores for receiving an unstripped, insulated portion of said electrical wires; and a plurality of transverse bores perpendicular to, and intersecting with, said longitudinal bores;

an electrically conductive bus encased within said block, said conductive bus comprising a conductive metal sheet with at least one rolled, hollow portion having opposing ends receiving and electrically coupling the stripped ends of the electrical wires when said electrical wires are fully inserted into said electrically conductive bus, the rolled, hollow portion having two crimps disposed approximately at the center of the hollow portion in mirror opposition for creating respective stops against which the stripped ends of the electrical wires make contact; and securing means extending through said transverse bores for abutting the unstripped, insulated portion of said electrical wires to secure said electrical wires within said block.

2. An electrical connector as recited in claim 1, wherein said electrically conductive bus comprises a conductive metal sheet with a plurality of rolled, hollowed portions for receiving, at opposite ends thereof, a respective plurality of pairs of said electrical wires.

3. An electrical connector as recited in claim 1, wherein said securing means extending through said transverse bores for abutting the unstripped, insulated portion of said electrical conductors comprise screws.

4. An electrical connector as recited in claim 3, wherein said screws are formed of insulating material.

5. An electrical connector as recited in claim 3, wherein said block is formed of plastic and said screws are formed of nylon.

6. An electrical connector as recited in claim 3, wherein said electrical wires comprise insulated stranded wire.

7. An electrical connector as recited in claim 3, wherein said electrical wires comprise insulated solid conductor wire.

* * * * *